United States Patent [19]

Steckler

[11] Patent Number: 4,941,336

[45] Date of Patent: Jul. 17, 1990

[54] LOCK MECHANISM

[76] Inventor: Edward T. Steckler, 124 Hershey Mill Rd., Apt. A-1, Mountville, Pa. 17554

[21] Appl. No.: 166,008

[22] Filed: Mar. 9, 1988

[51] Int. Cl.[5] ..... E05B 29/02

[52] U.S. Cl. ..... 70/365; 70/366

[58] Field of Search ..... 70/365, 366, 419, 357, 70/363

[56] References Cited

U.S. PATENT DOCUMENTS

| | | | |
|---|---|---|---|
| 1,896,523 | 2/1933 | Main | 70/365 X |
| 3,404,548 | 10/1968 | Keefer | 70/366 X |
| 4,073,171 | 2/1978 | Moorhouse | 70/366 |
| 4,196,606 | 4/1980 | Guiraud | 70/363 |

FOREIGN PATENT DOCUMENTS

| | | | |
|---|---|---|---|
| 632243 | 7/1936 | Fed. Rep. of Germany | 70/365 |
| 659113 | 6/1929 | France | 70/365 |
| 997552 | 1/1952 | France | 70/365 |

*Primary Examiner*—Robert L. Wolfe
*Assistant Examiner*—Suzanne L. Dino
*Attorney, Agent, or Firm*—Buchanan Ingersoll

[57] ABSTRACT

A lock mechanism is disclosed in which a hollow cylindrical housing is provided with at least one interior longitudinal slot. A cylinder having a longitudinal keyway is inserted into the housing and an endpiece having at least one radial groove and one circumferential groove is attached to the housing. At least one tumbler is pivotably mounted within the cylinder on an axis transverse to the cylinder. The tumbler has a locking edge sized and positioned to extend into the longitudinal groove in the housing when the tumbler is in a locked position and to be within the cylinder when the tumbler is in an unlocked position. The tumbler also has a tab sized and positioned so as to fit within the radial groove of the endpiece when the tumbler is in a locked position, and to align with and be capable of traveling through the circumferential groove of the endpiece when the tumbler is in an unlocked position. A keying edge is provided on the tumbler which has a given slope relative to a center line through the keyway and which extends into the keyway. The tumbler is spring biased to a locked position. It is moved to an unlocked position by the insertion of a key having a surface which is oriented and sloped to engage the keying edge of the tumbler and rotate the tumbler to an unlocked position.

9 Claims, 4 Drawing Sheets

LOCK MECHANISM

FIELD OF INVENTION

The invention relates to key operated lock mechanisms to restrict access to a room, area or container. My lock mechanism is primarily intended for use on doors, but it can be adopted for other applications.

DESCRIPTION OF THE PRIOR ART

There are dozens of key operated lock mechanisms which have been developed in the past. The most common employs tumblers and a key having a series of teeth cut into one edge.

The key is inserted into the lock. If the teeth are in proper alignment with the tumblers one can turn the key which moves the tumblers and releases the lock mechanism. This type of lock is relatively easy to pick. Therefore, efforts have been made to develop other lock mechanisms which are more secure.

Moorhouse in U.S. Pat. No. 4,073,171, issued Feb. 14, 1978, discloses a lock device having a plurality of rotatable cylindrical drums each having a latching member and one or more tumblers attached. The device is operated by a key comprised of a rod having pairs of radially extending flanges. When the key is inserted into the lock mechanism each pair of flanges is aligned with one of the rotatable cylinders. When the key is turned, the flanges engage and release the tumblers and turn the cylinders. The lock will release when all of the cylinders are aligned with one another. Although this lock device may be more complicated, it is still capable of being picked without undue difficulty, Because it is more complicated, this lock would be more difficult to manufacture than the common key locks. It would, therefore, be significantly more expensive.

Another lock mechanism, known as the Bramah lock, contains locking levers or cranks pivotably mounted about transverse axes which pivot into a completely unlocked state when a key is completely inserted. In this type of lock the key is formed so that when it is inserted it will cooperate with the nose of the levers and together with the levers function as tumblers. Guiraurd discloses one version of the Bramah lock in his U.S. Pat. No. 4,196,606, issued Apr. 8, 1980. Guiraurd proposes that horizontal and vertical tabs be cut at one end of the lever which will align with a housing only when the key is inserted. When the key is removed the tabs will move out of alignment and the lock mechanism will not turn. The Bramah lock is comprised of substantially more pieces than conventional key locks and is, therefore, more difficult and expensive to manufacture. Furthermore, the number of lock combinations are limited.

SUMMARY OF THE INVENTION

I have invented a lock mechanism with double locking capability which can be made with an almost infinite number of combinations. The lock is virtually pickproof and can be readily manufactured at a relatively low cost.

I prefer to provide a substantially solid cylinder having a longitudinal bore through its center and at least one radial slot. A tumbler is pivotally mounted in each slot on transverse axes. The tumbler is shaped so that when in a locked position it will project out of the cylinder and fit with a slot cut in a housing that surrounds the cylinder. When a key is inserted it will engage an edge of the tumbler and cause it to rotate. Rotation of the cylinder will cause a dead bolt or spring bolt to release or will create an electrical contact which will cause the door or container to open. The amount of tumbler rotation will depend upon the mating edges of the key and tumbler. These edges can be cut so that insertion of the key will cause the tumbler to rotate far enough so that it will no longer extend into the slot in the housing. A spring on the tumbler will cause the tumbler to return to its original locked position when the key is removed. The combination of my lock will depend upon the number of tumblers, the position of those tumblers relative to radii extending from the central bore, and the shape of the tumbler.

To provide double locking capability I prefer to provide a tab on each tumbler that extends from the tumbler to the exterior of the cylinder. I provide an endpiece which fits over the end of the cylinder into which the tumbler tabs extend. Each tab fits in a radial slot cut in the endpiece. I also provide circumferential grooves in the endpiece which are sized and positioned so that each tumbler tab will be aligned with a circumferential groove when the tumbler is in an unlocked position. When the tumbler is in the unlocked position, the tumbler tab can travel through the circumferential groove as the cylinder is turned. When the tumbler is locked each tab will be in a radial groove but not aligned with its mating circumferential groove. Hence, the cylinder cannot rotate.

Other details, objects and advantages of the invention will become apparent as a description of a present preferred embodiment of the invention proceeds.

DESCRIPTION OF THE PREFERRED EMBODIMENTS

Figure 1:
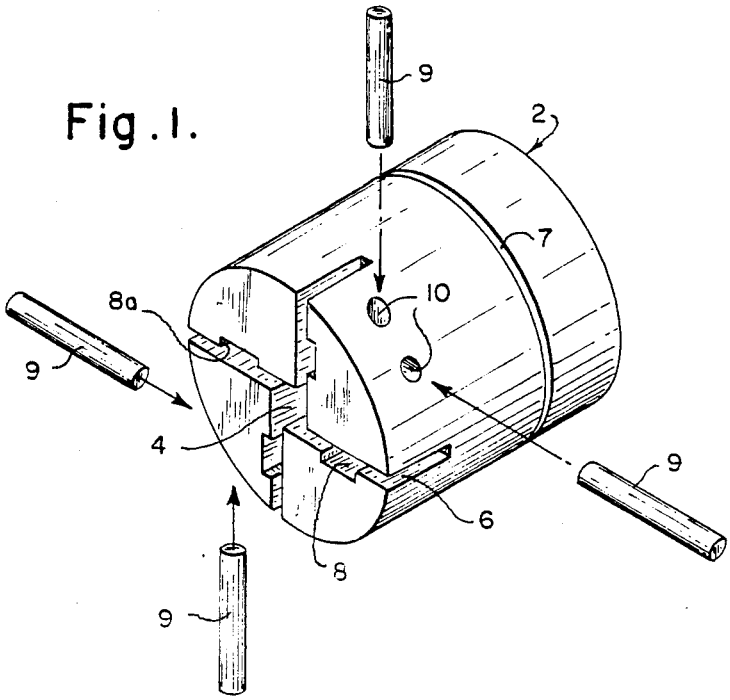
FIG. 1 is a perspective view of a present preferred embodiment of the cylinder used in my lock mechanism.
Figure 2:
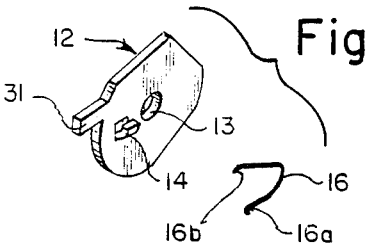
FIG. 2 is a perspective view of a present preferred embodiment of the tumbler used in my lock mechanism.
Figure 3:
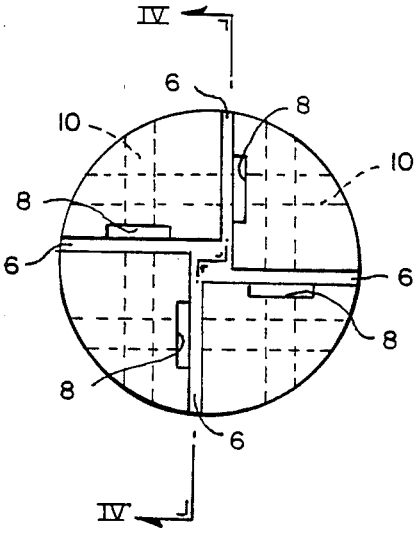
FIG. 3 is an end view of the cylinder shown in FIG. 1.
Figure 4:
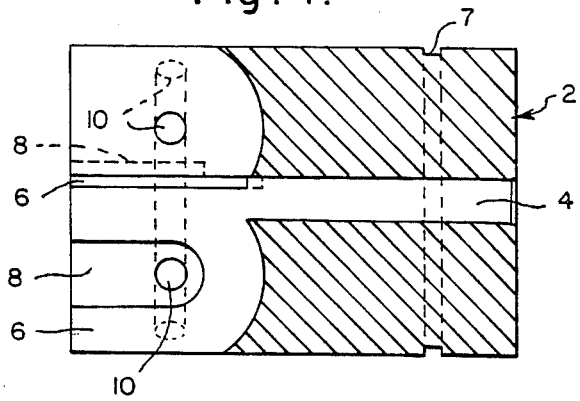
FIg. 4 is a cross-sectional view taken along the line IV—IV of FIG. 3.

My lock mechanism has five basic components: a cylinder, housing, endpiece, tumblers and a key. A present preferred embodiment of the cylinder is shown in FIGS. 1, 3, and 4. The cylinder 2 is a substantially cylindrical solid having a longitudinal central bore 4 and at least one radial slot 6 into which a tumbler 12 shown in FIG. 2 is inserted. The tumbler is held in place by a pin 9 passing through a transverse bore 10. As can be seen from FIGS. 1 and 2, pin 9 will pass through hole 13 in the tumbler 12 which is sized to permit the tumbler to pivot around pin 9. A post 14 is provided on the face of the tumbler 12 which provides a seat for spring clip 16. One end **16*a* of the spring clip 16 will fit into groove 15 cut into post 14. Secondary slots 8 are cut in cylinder 2 to provide clearance for the post 14 and spring 16. When the tumbler 12 is fitted into the cylinder one end 16*b* of spring 16 will press against a side 8*a* of groove 8 to hold the tumbler in a locked position, as shown in FIG. 5**.

Figure 7:
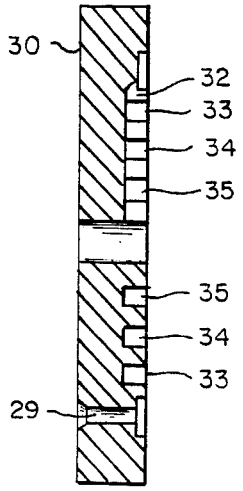
FIG. 7 is a cross-sectional view taken along the lines VII—VII of FIG. 6.
Figure 5:
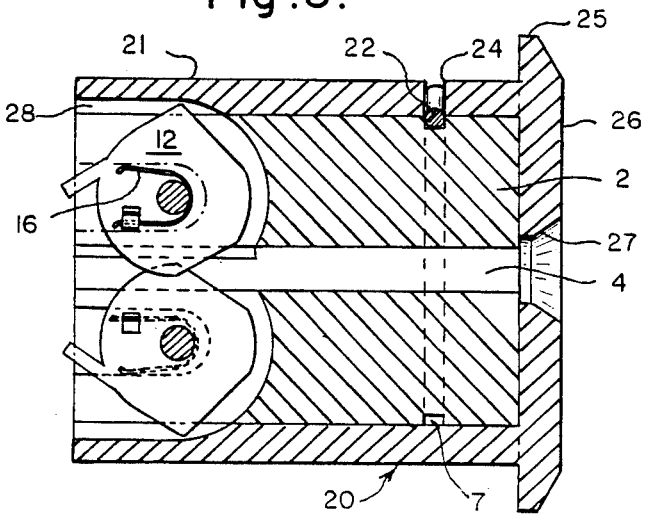
FIG. 5 is a cross-sectional view of the cylinder of FIG. 1 inserted into a housing and having two tumblers attached.
Figure 6:
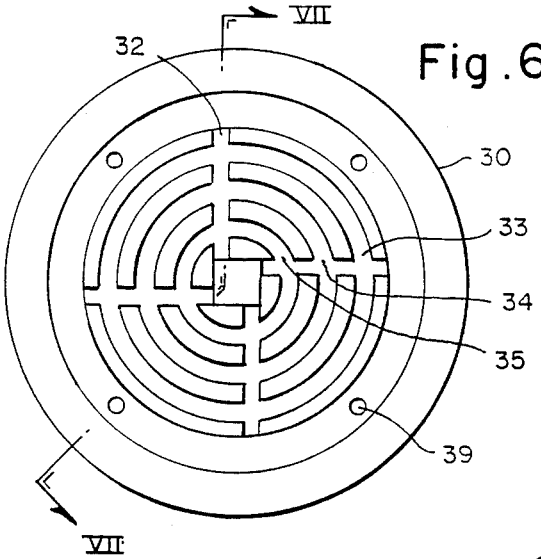
FIG. 6 is a plan view of a present preferred embodiment of the endpiece for my lock mechanism.
Figure 8:
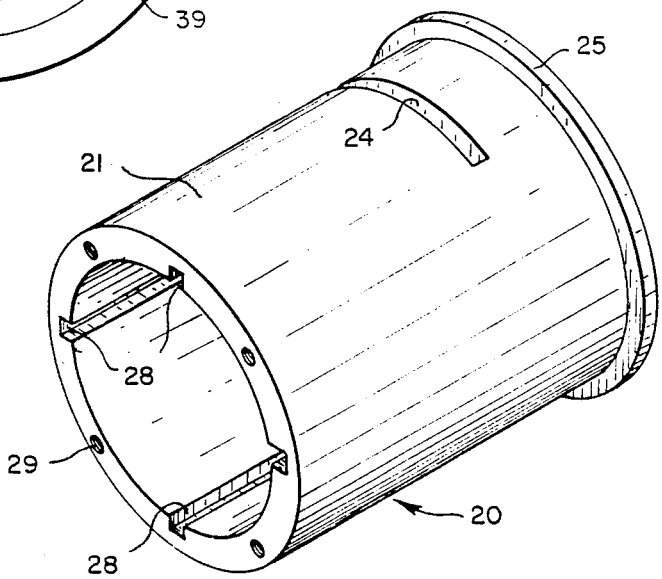
FIG. 8 is a perspective view of a present preferred embodiment of the housing for my lock mechanism.
Figure 9:
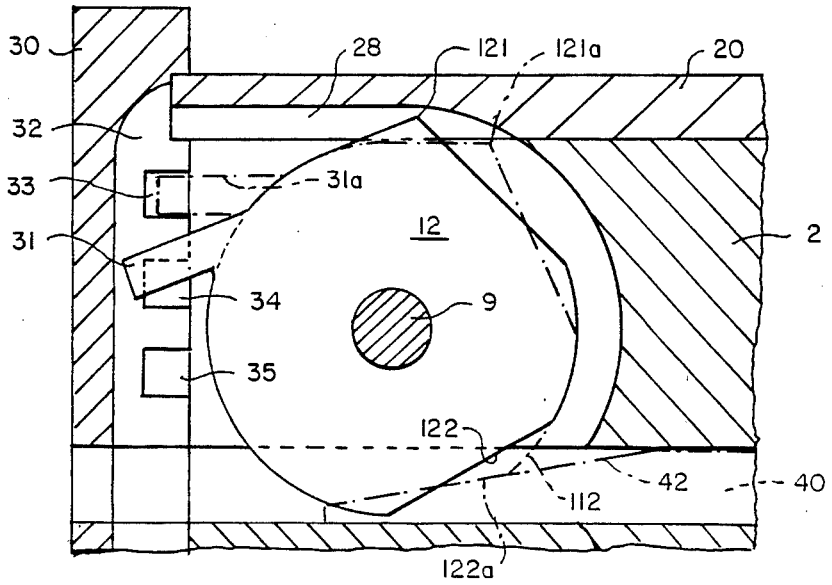
FIG. 9 is a fragmentary view of the cylinder, housing, endpiece and one tumbler in a locked position wherein the unlocked position of the tumbler is shown in chain line.
Figure 12:
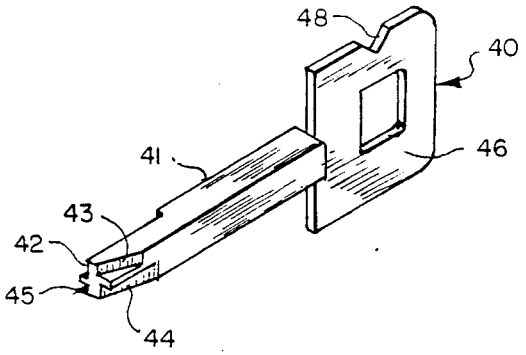
FIG. 12 is a perspective view of a present preferred embodiment of a key for my lock mechanism.
Figure 10:
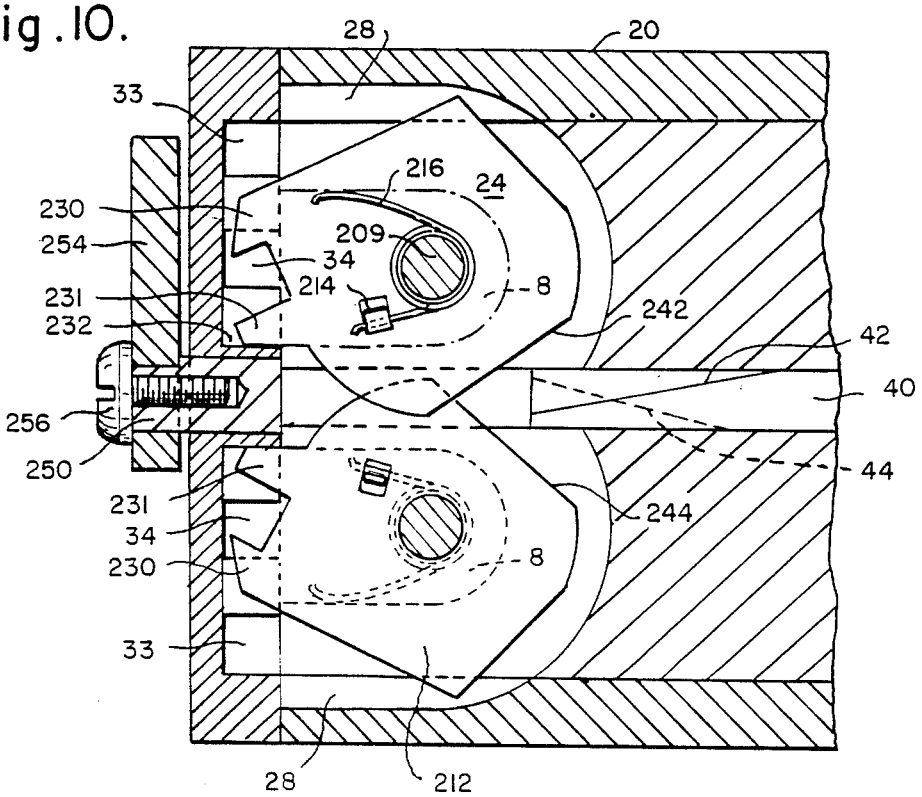
FIG. 10 is a cross-sectional view of a portion of a preferred embodiment of my lock mechanism with a key partially inserted.
Figure 11:
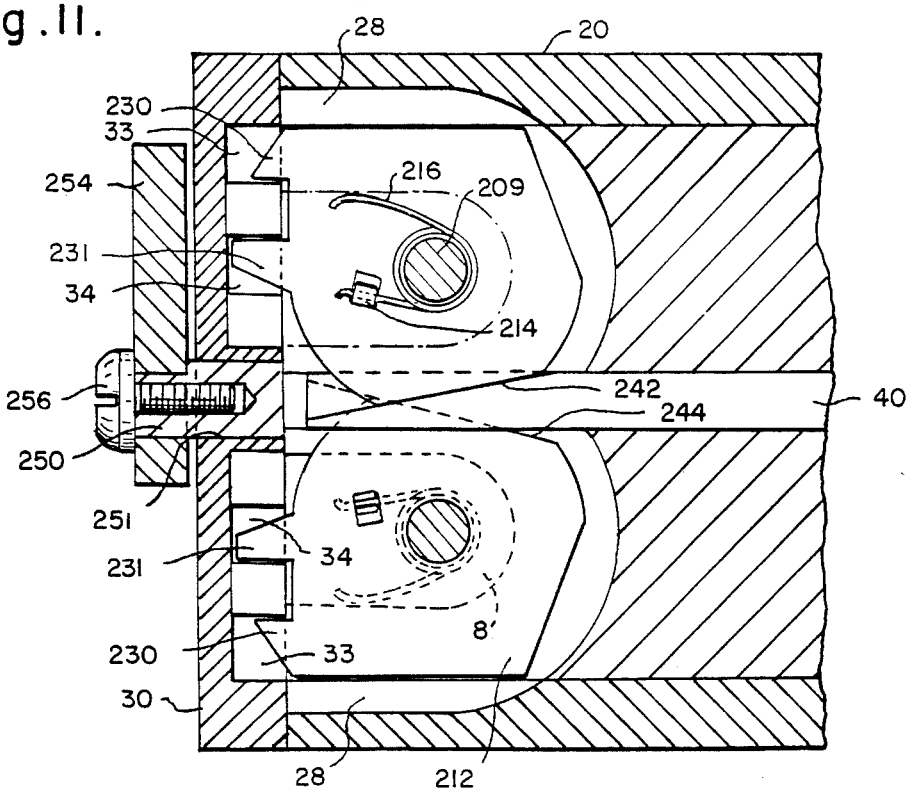
FIG. 11 is a cross-sectional view similar to FIG. 10 with the key fully inserted.

Referring now to FIGS. 5 and 8, the cylinder 2 is inserted into a housing 20 where it is held in place by a clip 22. The clip 22 is inserted through a slot 24 in the housing 20 until it engages a groove 7 cut in the cylinder. The housing 20 is a hollow cylindrical body 21 having a face plate 26 at one end. The face plate 26 is of somewhat greater diameter to provide a flange 25 which acts as a stop when the lock mechanism is inserted into a door. A keyhole 27 is cut in the center of the face plate 26 and is in alignment with bore 4 in the cylinder. I prefer to provide sloping sides on the keyhole to make key insertion easier. Grooves 28 are cut along the inner surface of the housing 20 to accommodate tumblers 12. When the tumblers 12 are in a locked position, they will protrude into groove 28 preventing the cylinder 2 from rotating relative to the housing 20. Finally, threaded holes 29 are cut in the end of the housing to receive screws which hold the endpiece in place. The endpiece 30, shown in FIGS. 6 and 7 is generally cylindrical having a diameter larger than the housing body 21. At least one substantially radial groove 32 is cut in the face of the endpiece 30. These grooves are sized and positioned to receive a tab 31 which protrudes from the tumblers (see FIG. 2). One may choose to use a single tab as shown in FIGS. 2, 5 and 9, or one may use two or more tabs as shown in FIGS. 10 and 11. As the tumbler pivots, the tab 31 can move through this groove 32. I also provide one or more circumferential grooves 33, 34 and 35 in the face of the endpiece 30. When the tumbler is in an unlocked position tab 31 will line up with one of these grooves and travel through the groove when the cylinder 2 is rotated relative to the housing 20. Tab 31 will not align with a circumferential groove when the tumbler is in a locked position. Being out of alignment, the tab will prevent the cylinder from rotating relative to the housing. The endpiece 30 is attached to the housing 20 by screws which pass through holes 39.

The operation of my lock mechanism can be best understood by referring to FIGS. 9 through 13. In FIG. 9 I show a tumbler 12 in a locked position and a second tumbler 112 shown in chain line in an unlocked position. It is to be understood that a single tumbler would pivot from the unlocked position of tumbler 112 to the locked position of tumbler 12. In the locked position a portion 121 of tumbler 12 extends into groove 28 of housing 20. In addition, tab 31 does not align with any of the circumferential grooves 33, 34 or 35 in the endpiece 30. When a key 40 whose end is shown in chain line in FIG. 9 is inserted, face 42 of the key engages edge 122 of the tumbler. As the key is pushed into the lock, tumbler 12 will turn to an unlocked position shown by tumbler 112. In this position the tumbler no longer protrudes into gap 28 as portion 121 has moved to point **121*a*. Tab 31 has moved to tab 31*a* and is in line with circumferential groove 33. When the key is removed the tumbler will return to its original position. The amount by which the tumbler rotates is determined by the slope of tumbler edge 122 and the slope of key face 42. If the slopes do not match, tumbler 12 will rotate too much or too little. In either event, tab 31 would not align with a circumferential groove, or point 121 will be in slot 28 of the housing 21** or both will happen.

FIGS. 10 and 11 are sectional views similar to FIG. 4 showing a pair of tumblers having two tabs in locked and unlocked positions. Referring to these figures, tumblers 211 and 212 are fitted over pins 9 that pass through cylinder 2. A spring clip 216 is fitted around pin 209 and is seated at one end in clip support 214. The other end of the clip rests against the edge **8*a* of slot 8 shown in chain line over tumbler 211 and in dotted line when it is covered by tumbler 212. Two tabs 230 and 231 project from tumblers 211 and 212 into radial lot 32 in endpiece 30. Endpiece 30 has two circumferential grooves 33 and 34. When the tumblers are in a locked position the tabs 230 and 231 will not be aligned with the circumferential grooves and the tumbler will extend into slot 28 of housing 20. The tumblers are activated by a key 40 which is inserted through keyway 4. The key is cut to have sloped surfaces 42 and 44 which will engage edges 242 and 244 of tumblers 211 and 212. For the tumblers shown in FIG. 10 to reach the unlocked position shown in FIG. 11, they must rotate 25°. In the locked position edges 242 have a slope of 35° from the horizontal and edge 244 is sloped at 40° from the horizontal. To achieve a 25° rotation of both tumblers 211 and 212, key face 42 must have a slope of 10° and key face 44 must have a slope of 15°. When the key 40 is fully inserted tumblers 211 and 212 will have moved to an unlocked position. When the key 40 is removed spring clip 216 will return the tumblers back to a locked position. To prevent the tumblers from rotating too far when the key is removed the radial groove 32 can be cut so that tab 231 will rest against the bottom edge 232** of the groove when the tumbler is in a locked position.

I prefer to provide four tumblers in my lock mechanism as indicated by FIGS. 1 and 3. Such an arrangement would require a key like that shown in FIG. 12. One end of the body 41 of the key 40 has four sloped surfaces 42, 43, 44 and 45 each of which engage a tumbler. A handle 46 is attached to the opposite end of the body. A notch 48 or other marking is provided to indicate the proper orientation of the key when it is inserted into the shaft. I prefer to make the body 41 of the key 40 substantially rectangular; however, other shapes could be used. Although I have shown a key with flat edges, grooves could be cut along the body 41 to accommodate teeth projecting into the keyhole or keyway. One could also choose to use more or less than four tumblers. No matter how many tumblers are used, there must be a mating surface on the end of the key oriented to engage each tumbler. Each surface would have a slope compatible with the edge of the tumbler.

For a given embodiment of my lock mechanism there are several ways to change the combination. First, one could change the radial orientation of the tumblers relative to the cylinder's longitudinal bore. Second, one could change the slope on the edge of the tumbler which mates with the key. Third, one could change the position of the tabs and circumferential grooves in the endpiece. Finally, one could also change the size of any component. The possible permutations of these factors are tremendous. Hence, hundreds of my locks could be made so that no two of them are exactly alike.

Another advantage of my lock mechanism is that the tumblers are free to rotate past the unlocked position. If that occurs the cylinder will not turn. It is, therefore, extremely difficult to pick my lock with a hairpin or other object.

Figure 13:
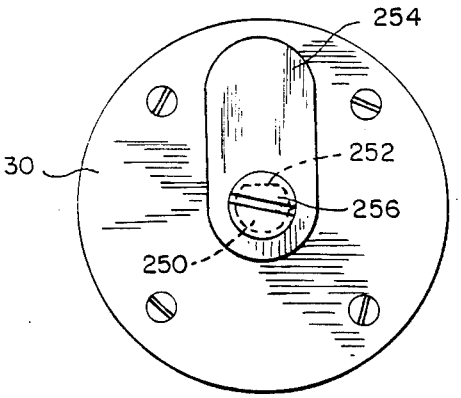
FIG. 13 is an end view of my lock mechanism fully assembled and having a lever attached which activates a bolt.

Those skilled in the art will recognize that my lock could be adapted to operate a variety of dead bolts and spring locks, or could be used to activate an electrical mechanism. In FIGS. 10, 11 and 13, I illustrate one possible way in which my lock mechanism could be used. As shown in those Figures, I provide a stub shaft 250 which extends from cylinder 2 through a hole 251 in endpiece 30. This shaft would be generally round with a flat surface 252. A tab 254 is fitted over the shaft 250 to activate a bolt or to otherwise serve to lock and release a door or container. This arrangement could also be adapted for an electrical lock by making tab 254 of a nonconductive material and applying a strip of solder across it. An end cap (not shown) would be fitted over tab 254. This end cap would contain two or three contact points which would abut the solder strip to complete a circuit when the tab 254 is in an unlocked position. The contacts would not touch the solder strip when tab 254 is in a locked position. Tab 254 is held in place by a screw 256 which fits into a screw hole through the center of shaft 250.

While I have shown certain present preferred embodiments of my invention, it is to be distinctly understood that the invention is not limited thereto but may be variously embodied within the scope of the following claims.

I claim:

1. A lock mechanism comprising a. a hollow cylindrical housing having an outer surface, an inner surface and at least one longitudinal groove cut into its inner surface, b. a face plate having a key hole therein and attached to one end of the housing, c. a cylinder having a longitudinal keyway and inserted into the housing, so that the keyway is aligned with the key hole, d. an endpiece having a face and attached at its face to the housing opposite the face plate and having at least one circumferential groove and at least one radial groove cut in its face, e. four tumblers (i) pivotably mounted at approximately 90° intervals to the cylinder on an axis transverse the cylinder, (ii) having a locking edge sized and positioned so as to extend into the longitudinal groove in the housing when the tumbler is in a locked position, and to be within the cylinder when the tumbler is in an unlocked position, (iii) having at least one tab sized and positioned so as to fit within a radial groove of the endpiece when the tumbler is in a locked position and to align with and be capable of traveling through a circumferential groove in the endpiece when the tumbler is in an unlocked position, and (iv) having a keying edge which has a given slope relative to a center line through the keyway and which extends into the keyway, said tumblers being sized and positioned to be able to pivot from a locked position to an unlocked position; and f. a resilient means attached to the tumbler to bias the tumbler toward a locked position.

2. The lock mechanism of claim 1 also comprising a key sized and positioned to fit through the keyway and having a surface at one end which is sized and positioned to engage the keying edge of the tumbler and cause the tumbler to rotate to an unlocked position as the key is fully inserted into the keyway.

3. The lock mechanism of claim 2 wherein the key is comprised of a shaft having a surface at one end which is sized and positioned to engage the keying edge of each tumbler and a handle at its opposite end bearing indicia which indicates the proper orientation of the key for insertion into the keyway.

4. The lock mechanism of claim 1 wherein the cylinder is a cylindrical solid having for each tumbler a radial slot sized and positioned to receive the tumbler and a transverse bore through each groove and also comprising a pin inserted into each transverse bore and on which a tumbler is pivotably attached.

5. The lock mechanism of claim 1 also comprising a retainer for maintaining the cylinder in a given longitudinal position relative to the housing.

6. The lock mechanism of claim 5 wherein the cylinder has a circumferential groove about its outer surface, the housing has a slot which aligns with the circumferential groove when the cylinder is inserted into the housing, and the retainer is a snap pin fitted into the housing slot and engaging the cylinder's circumferential groove.

7. The lock mechanism of claim 1 having a shaft attached to the cylinder adjacent the keyway and passing through the endpiece so that when the cylinder turns the shaft will rotate.

8. A lock mechanism comprising a. a hollow cylindrical housing, b. a face plate having a key hole therein and attached to one end of the housing, c. a cylinder having a longitudinal keyway and inserted into the housing, so that the keyway is aligned with the key hole, d. an endpiece having a face plate and attached at its face to the housing opposite the face plate and having at least one circumferential groove and at least one radial groove cut in its face, e. four tumblers (i) pivotably mounted at approximately 90° intervals to the cylinder on an axis transverse to the cylinder, (ii) having at least one tab sized and positioned so as to fit within a radial groove of the endpiece when the tumbler is in a locked position and to align with and be capable of traveling through a circumferential groove in the endpiece when the tumbler is in an unlocked position, and (iii) having a keying edge which has a given slope relative to a center line through the keyway and which extends into the keyway, said tumblers being sized and positioned to be able to pivot from a locked position to an unlocked; and f. a resilient means attached to the tumbler to bias the tumbler toward a locked position.

9. The lock mechanism of claim 8 also comprising key sized and positioned to fit through the keyway and having a surface at one end which is sized and positioned to engage the keying edge of the tumbler and cause the tumbler to rotate to an unlocked position as the key is fully inserted into the keyway.

* * * * *